US009840084B2

(12) United States Patent
Nakamura et al.

(10) Patent No.: US 9,840,084 B2
(45) Date of Patent: Dec. 12, 2017

(54) LIQUID EJECTING APPARATUS

(71) Applicant: SEIKO EPSON CORPORATION, Tokyo (JP)

(72) Inventors: Kotaro Nakamura, Chikuhoku (JP); Takashi Mano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/337,623

(22) Filed: Oct. 28, 2016

(65) Prior Publication Data

US 2017/0120618 A1 May 4, 2017

(30) Foreign Application Priority Data

Oct. 30, 2015 (JP) ..... 2015-215006

(51) Int. Cl.
*B41J 2/175* (2006.01)

(52) U.S. Cl.
CPC ..... *B41J 2/17596* (2013.01); *B41J 2/17523* (2013.01)

(58) Field of Classification Search
CPC ..... B41J 2/17523; B41J 2/17596
USPC ..... 347/85
See application file for complete search history.

(56) References Cited

U.S. PATENT DOCUMENTS 6,318,851 B1 * 11/2001 Hoen ..... B41J 2/19 347/92
2001/0020970 A1 * 9/2001 Kuribayashi ..... B41J 2/175 347/85
2002/0071002 A1 * 6/2002 Kawamura ..... B41J 2/17523 347/50
2003/0001934 A1 * 1/2003 Kitabatake ..... B41J 2/17503 347/86
2007/0158475 A1 7/2007 Kimura et al.

FOREIGN PATENT DOCUMENTS

JP 2001-018412 1/2001
JP 2005-059586 3/2005

* cited by examiner

*Primary Examiner* — Huan Tran
*Assistant Examiner* — Alexander D Shenderov
(74) *Attorney, Agent, or Firm* — Workman Nydegger

(57) ABSTRACT

A liquid ejecting apparatus including a liquid ejecting head that ejects liquid; a head flow path connected to the liquid ejecting head, that supplies the liquid; an attaching member that is attachable at a position adjacent to the head flow path; and an opening/closing mechanism that opens the head flow path when the attaching member is attached at the adjacent position and closes the head flow path when the attaching member is removed from the adjacent position.

8 Claims, 9 Drawing Sheets

LIQUID EJECTING APPARATUS

BACKGROUND

1. Technical Field

The present invention relates to a liquid ejecting apparatus.

2. Related Art

Ink jet printers have been known as an example of a liquid ejecting apparatus that perform printing on paper (recording media) by ejecting ink (liquid) from an ink jet head (liquid ejecting head). In such liquid ejecting apparatuses, in some cases a head flow path connected to a liquid ejecting head is removed in order to perform maintenance on the liquid ejecting head. However, the head flow path is in a state filled with liquid and handling in this state is problematic.

JP-A-2001-18412 describes an ink jet recording apparatus including a joint portion for connecting a recording head. The joint portion includes a joint cylinder for connecting a supply tube, a joint cap formed from an ink-sealing member for preventing ink within the joint cylinder from leaking, and slender ink supply needle to be fixed and attached in a cylinder cap. According to the technique described in JP-A-2001-18412, when the joint portion is removed from the recording head, the ink supply needle is covered by the joint cap and the ink stored in the supply tube is prevented from leaking.

However, the technique described above is configured so that the head flow path is closed simultaneously with the removal of the head flow path from the liquid ejecting head. Consequently, unless the head flow path is removed slowly, the seal will be imperfect, resulting in a risk of the liquid leaking from the head flow path at a time of replacing the liquid ejecting head. Additionally, maintenance work needs to be performed in a short period of time in order to minimize downtime of the liquid ejecting apparatus and, if the liquid leaks, unnecessary cleaning time may be required.

SUMMARY

An advantage of some aspects of the invention is that a liquid ejecting apparatus is provided whereby leakage of liquid from a head flow path can be prevented and maintenance can be performed in a short period of time.

According to an aspect of the invention, a liquid ejecting apparatus has a configuration including a liquid ejecting head that ejects liquid; a head flow path connected to the liquid ejecting head, that supplies the liquid; an attaching member that is attachable at a position adjacent to the head flow path; and an opening/closing mechanism that opens the head flow path when the attaching member is attached at the adjacent position and closes the head flow path when the attaching member is removed from the adjacent position.

According to this configuration, the attaching and removing of the attaching member that is attachable at the position adjacent to the head flow path can be associated with the opening and the closing of the head flow path. As such, the attaching member is removed from the position adjacent to the head flow path before the head flow path is removed from the liquid ejecting head and, therefore, the head flow path can be closed in advance by the opening/closing mechanism. Accordingly, when removing the head flow path in order to replace the liquid ejecting head or the like, leaking of the liquid can be prevented, maintenance can be performed in a short period of time, and serviceability can be improved.

It is preferable that the adjacent position be set outside the head flow path.

According to this configuration, the head flow path can be closed from the outside by removing the attaching member that is attached outside the head flow path and, therefore, leaking of the liquid can be reliably prevented.

It is preferable that the opening/closing mechanism have a configuration that includes, within the head flow path, a valve body that is movable between an open position where the head flow path is open and a closed position where the head flow path is closed, and of which at least one portion is formed from a magnetic material; within the head flow path, a urging member that biases the valve body from the open position toward the closed position; and a magnet that is provided on the attaching member and that resists the urging and positions the valve body at the open position while the attaching member is attached at the adjacent position.

According to this configuration, while the attaching member is attached at the position adjacent to the head flow path, the magnet provided on the attaching member is magnetically attracted to the valve body that includes the magnetic material, thereby opening the head flow path. Additionally, when the attaching member is removed from the position adjacent to the head flow path, the magnetic force of the magnet ceases to act, the urging member causes the valve body to move to the closed position, and the head flow path is closed.

It is preferable that the opening/closing mechanism have a configuration that includes a flexible film that forms a portion of the head flow path; within the head flow path, a valve body that is movable between an open position where the head flow path is open and a closed position where the head flow path is closed; within the head flow path, a urging member that biases the valve body from the open position toward the closed position; and a pressing member that is provided on the attaching member and that resists the urging and positions the valve body at the open position by pressing the valve body via the flexible film while the attaching member is attached at the adjacent position.

According to this configuration, while the attaching member is attached at the position adjacent to the head flow path, the pressing member provided on the attaching member presses on the valve body via the flexible film, thereby opening the head flow path. Additionally, when the attaching member is removed from the position adjacent to the head flow path, the pressing by the pressing member ceases to be applied, the urging member causes the valve body to move to the closed position, and the head flow path is closed.

It is preferable that the liquid ejecting apparatus have a configuration further including a first fixing member that fixes the head flow path to the liquid ejecting head; and an interfering portion positioned on an operation path of the first fixing member when the attaching member is attached at the adjacent position.

According to this configuration, the interfering portion disables the operation of the first fixing member and, therefore, unless the attaching member is removed in advance, the head flow path cannot be removed from the liquid ejecting head. As a result, situations can be avoided where the head flow path is removed from the liquid ejecting head while the head flow path is not closed, which would lead to leaking of the liquid.

It is preferable that the liquid ejecting apparatus have a configuration further including a supporting member that supports the liquid ejecting head; and a second fixing member that fixes the liquid ejecting head together with the attaching member to the supporting member.

According to this configuration, the attaching member is removed when the second fixing member operates and releases the fixing between the liquid ejecting head and the supporting member. As a result, the head flow path can be closed simultaneously with the releasing of the fixing between the liquid ejecting head and the supporting member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
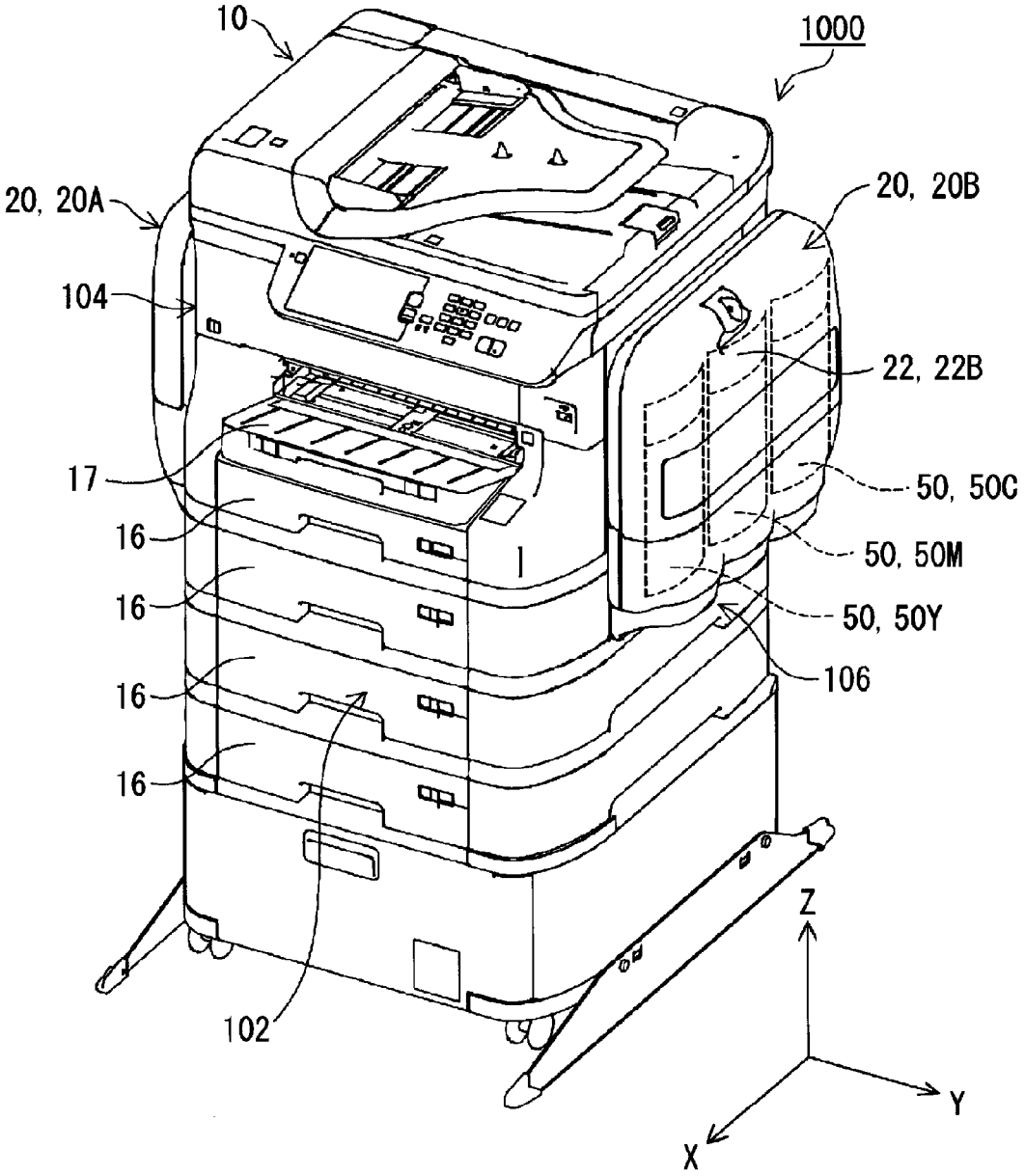
FIG. 1 is a perspective view illustrating an overall appearance of a liquid ejecting apparatus according to a first embodiment of the invention.

Hereinafter, embodiments of a liquid ejecting apparatus according to the invention will be described while referencing the drawings. In the drawings used in the following description, the scale of each constituent is appropriately adjusted to a recognizable size.

First Embodiment

Figure 2:
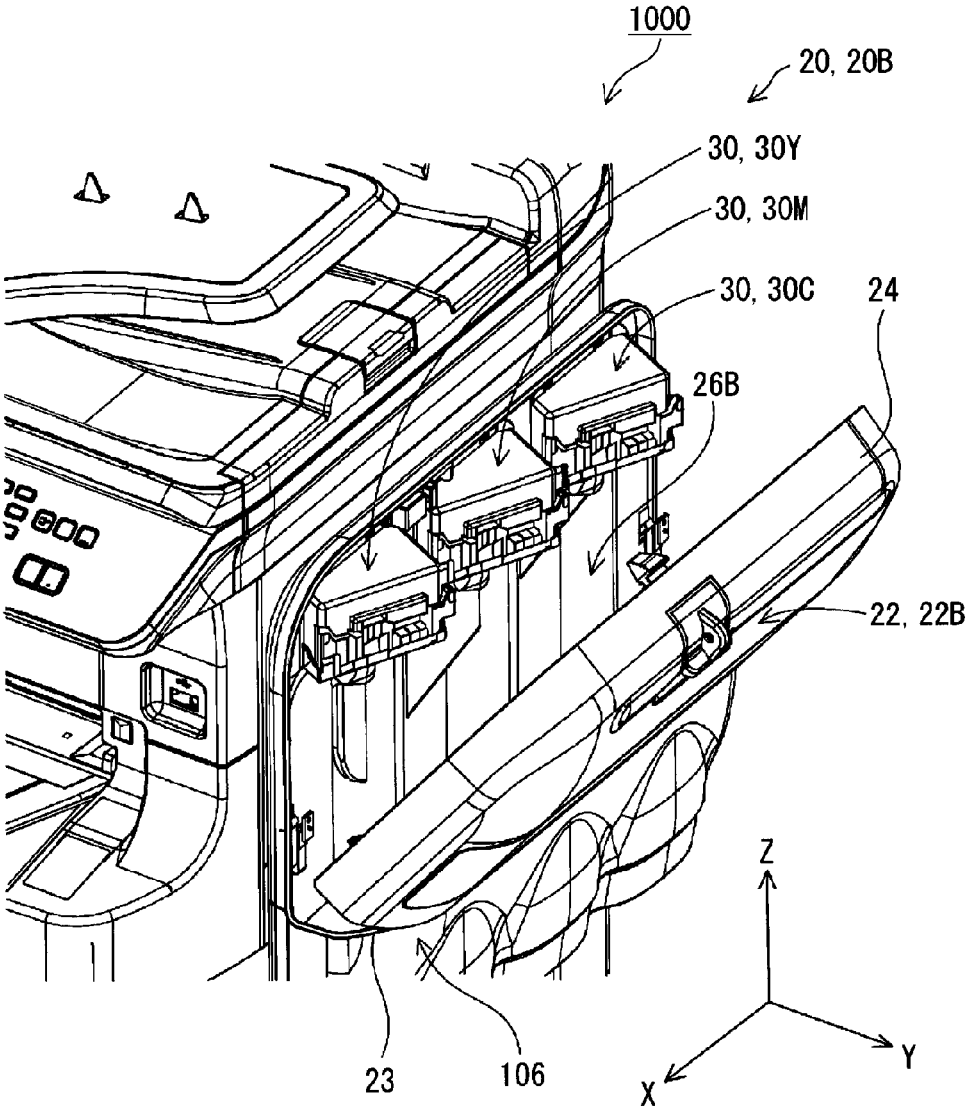
FIG. 2 is a perspective view illustrating the liquid ejecting apparatus according to the first embodiment of the invention, in a state where a side portion is opened.

FIG. 1 is a perspective view illustrating an overall appearance of a liquid ejecting apparatus 1000 according to a first embodiment of the invention. FIG. 2 is a perspective view illustrating the liquid ejecting apparatus 1000 according to the first embodiment of the invention, in a state where a side portion is opened.

Note that, in FIGS. 1 and 2, an XYZ orthogonal coordinate system is set. In the liquid ejecting apparatus 1000, a front/rear direction is the X-axis direction, a direction orthogonal to the X-axis direction in the horizontal plane is the Y-axis direction (horizontal direction), and a direction (vertical direction) orthogonal to each of the X-axis direction and the Y-axis direction is the Z-axis direction.

As illustrated in FIG. 1, the liquid ejecting apparatus 1000 includes an apparatus body 10 and two liquid supplying devices 20. In a state of usage of the liquid ejecting apparatus 1000, the apparatus body 10 is set on a horizontal plane defined by the X-axis direction and the Y-axis direction. The liquid supplying devices 20 supply ink as a liquid to the apparatus body 10. A liquid container 50 that contains a liquid is detachably connected (mounted) to the liquid supplying devices 20. In the present embodiment, a pack-type container in which a liquid is stored is used as the liquid container 50.

The apparatus body 10 is an ink jet printer. The apparatus body 10 is provided with a paper feeding tray 16 and a discharge tray 17. The paper feeding tray 16 and the discharge tray 17 are provided on an apparatus front face 102 of the apparatus body 10. The paper feeding tray 16 is provided in plurality at positions of different heights in a vertical direction. Recording media (e.g. paper), on which text, images, and the like are to be printed (recorded) by the apparatus body 10, is stored in the paper feeding tray 16. Recording media on which images have been recorded by the apparatus body 10 is discharged on the discharge tray 17.

The two liquid supplying devices 20 are provided on an apparatus left side 104 and on an apparatus right side 106 of the apparatus body 10. One of the liquid supplying devices 20 provided on the apparatus left side 104 is called first liquid supplying device 20A, and the other of the liquid supplying devices 20 provided on the apparatus right side 106 is called second liquid supplying device 20B. Note that in cases where the first and second liquid supplying devices 20A and 20B are used without differentiating between them, the first and second liquid supplying devices 20A and 20B are simply called the liquid supplying devices 20.

The liquid supplying devices 20 include a case member 22, the liquid container 50, and an attachment unit 30 (FIG. 2). One of the liquid container 50 and one of the attachment unit 30 are housed in the first liquid supplying device 20A (FIG. 3, described later), and three of the liquid container 50 and three of the attachment unit 30 are housed in the second liquid supplying device 20B. Note that the number of the liquid container 50 and the number of the attachment unit 30 are examples.

Types of liquid that are different from each other are stored (filled) in the four liquid containers 50. In the present embodiment, yellow (Y), magenta (M), cyan (C), and black (K) liquids are each stored respectively in the four liquid containers 50. A liquid container 50K in which the black liquid is stored (FIG. 3, described later) is housed in a housing space 26A inside a case member 22A (third case member) of the first liquid supplying device 20A. A liquid container 50C in which the cyan liquid is stored, a liquid container 50M in which the magenta liquid is stored, and a liquid container 50Y in which the yellow liquid is stored are housed in a housing space 26B (FIG. 2) inside a case member 22B (second case member) of the second liquid supplying device 20B.

The attachment unit 30 is detachably mounted on the liquid container 50. As illustrated in FIG. 2, the attachment unit 30C is mounted on the liquid container 50C, the attachment unit 30M is mounted on the liquid container 50M, and the attachment unit 30Y is mounted on the liquid container 50Y. The attachment unit 30 is arranged inside the case member 22. When the attachment unit 30 is mounted on the liquid container 50, the liquid stored in the liquid container 50 is supplied to a liquid ejecting head 60 (FIG. 3, described later) of the apparatus body 10 by a supplying mechanism (not illustrated) having a pump function provided in the apparatus body 10.

As illustrated in FIG. 2, the case member 22 is configured to open and close by rotating a second edge portion 24 that has a first edge portion 23 rotatably connected to the apparatus body 10 as a fulcrum. After the liquid stored in the liquid container 50 has been consumed, a user opens the case member 22 and removes the consumed liquid container 50 from the attachment unit 30. Then, the user mounts a new liquid container 50 on the attachment unit 30 and, thereafter, closes the case member 22.

Figure 3:
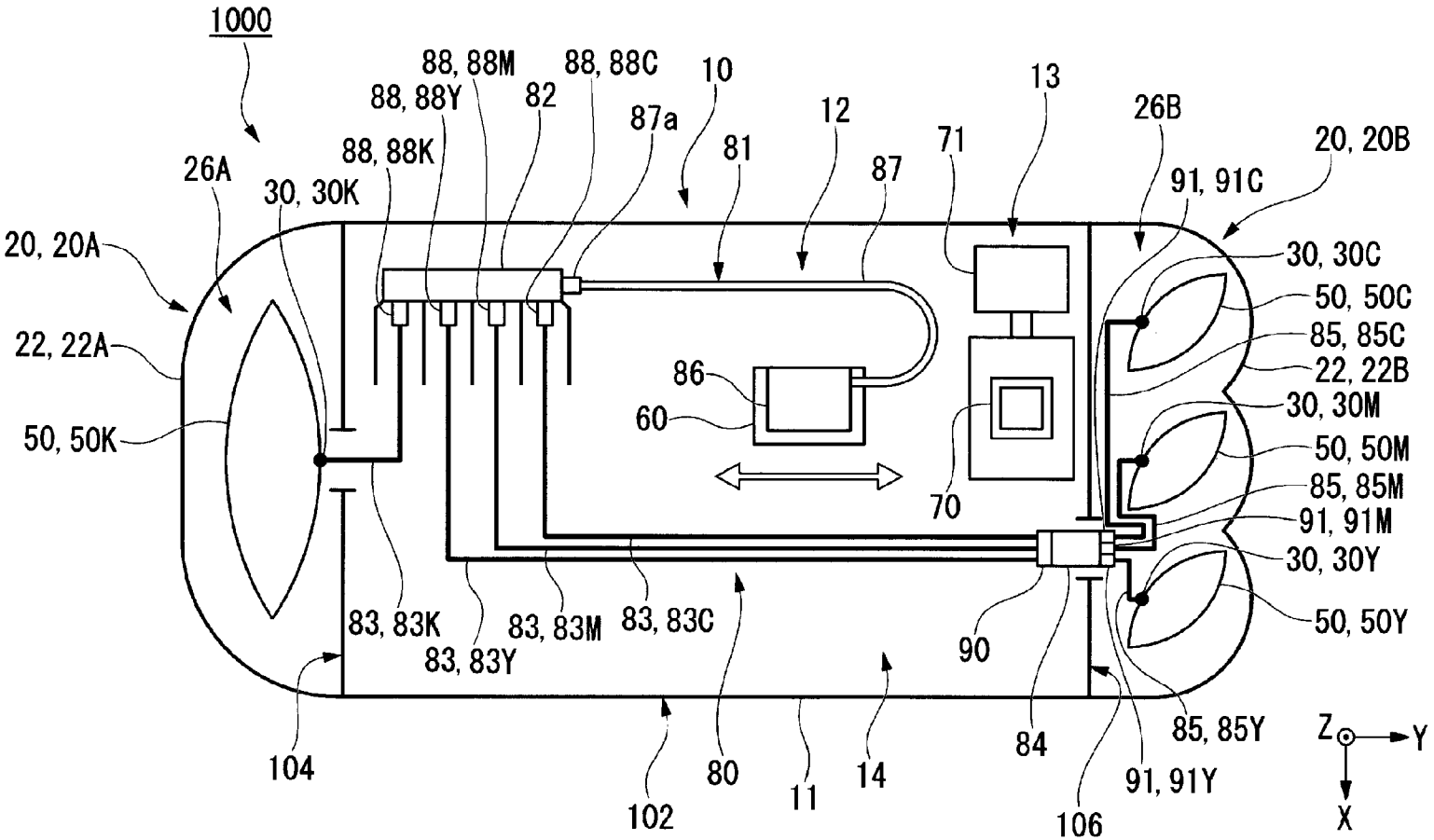
FIG. 3 is a schematic configuration diagram of an interior of the liquid ejecting apparatus according to the first embodiment of the invention.

FIG. 3 is a schematic configuration diagram of an interior of the liquid ejecting apparatus 1000 according to the first embodiment of the invention.

As illustrated in FIG. 3, the apparatus body 10 includes a case member 11 (first case member), a liquid ejecting unit 12, and a maintenance unit 13. The liquid ejecting unit 12 and the maintenance unit 13 are housed in a housing space 14 inside the case member 11.

The liquid ejecting unit 12 prints images on the recording media by ejecting liquid while moving the liquid ejecting head 60 in the Y-axis direction (primary scanning direction), while simultaneously transporting the recording media in the X-axis direction (secondary scanning direction) using a transporting device (not illustrated). The liquid ejecting head 60 is an ink jet head and, for example, drives a plurality of piezoelectric vibrators to eject liquid from a plurality of nozzles. Nozzle rows are formed in the liquid ejecting head 60 for each type of liquid.

A region called a home position is provided at a position outside a printing region to which the liquid ejecting head 60 is moved in the primary scanning direction and, the maintenance unit 13 that performs maintenance to ensure normal printing is disposed at the home position. The maintenance unit 13 includes a cap member 70 that presses on a nozzle surface where a nozzle of the liquid ejecting head 60 is formed and that forms a closed space so as to enclose the nozzle; a lifting/lowering mechanism (not illustrated) that lifts/lowers the cap member 70 in order to press against the nozzle surface of the liquid ejecting head 60; a suction pump (not illustrated) that introduces negative pressure to the closed space formed by the cap member 70 being pressed against the nozzle surface of the liquid ejecting head 60; and a waste liquid tank 71 that stores the liquid suctioned via the suction pump.

The liquid ejecting apparatus 1000 includes a liquid supply system 80 that supplies liquid from the liquid container 50 to the liquid ejecting head 60. The liquid supply system 80 includes a head flow path 81, a first relay portion 82, first flow paths 83, a second relay portion 84, and second flow paths 85. The head flow path 81 includes a coupling member 86 that connects to the liquid ejecting head 60, a multi-row flexible tubing 87 in which flow paths for each of the types of liquid are formed, and a coupling member 87*a* that connects to the first relay portion 82. A first end of the head flow path 81 is connected to the liquid ejecting head 60 and a second end of the head flow path 81 is connected to the first relay portion 82.

The first relay portion 82 connects the head flow path 81 with the first flow paths 83, and is housed in the housing space 14 inside the case member 11.

The first flow paths 83 are provided in plurality for each type of liquid. A first flow path 83K through which black liquid flows is a liquid supply tube that constitutes a connection between the first relay portion 82 and the attachment unit 30K. The first flow path 83K includes a coupling member 88 (referred to as "coupling member 88K") that connects to the first relay portion 82. As distance to the first relay portion 82 is short, the first flow path 83K directly connects the first relay portion 82 with the attachment unit 30K.

First flow paths 83C, 83M, and 83Y through which cyan, magenta, and yellow liquid respectively flow are liquid supply tubes that each constitute a connection between the first relay portion 82 and the second relay portion 84. The first flow paths 83C, 83M, and 83Y each include the coupling member 88 (referred to as "coupling members 88C, 88M, and 88Y", respectively) that connects to the first relay portion 82, and a common coupling member 90 that connects to the second relay portion 84.

The second relay portion 84 connects each of the first flow paths 83 with a corresponding one of the second flow paths 85, and is provided across the case member 11 and the case member 22B.

In the present embodiment, the first flow path 83K is configured to directly connect to the attachment unit 30K, but may be configured so as to connect to via a relay portion provided across the case member 11 and the case member 22A, in the same manner as the first flow paths 83C, 83M, and 83Y.

The second flow paths 85 are provided in plurality for each of the cyan, magenta, and yellow liquids. Second flow paths 85C, 85M, and 85Y through which cyan, magenta, and yellow liquid respectively flow are liquid supply tubes that each constitute a connection between the second relay portion 84 and the attachment units 30C, 30M, and 30Y.

The second flow paths 85C, 85M, and 85Y include coupling members 91 (referred to as "coupling members 91C, 91M, and 91Y") that connect to the second relay portion 84.

Figure 4:
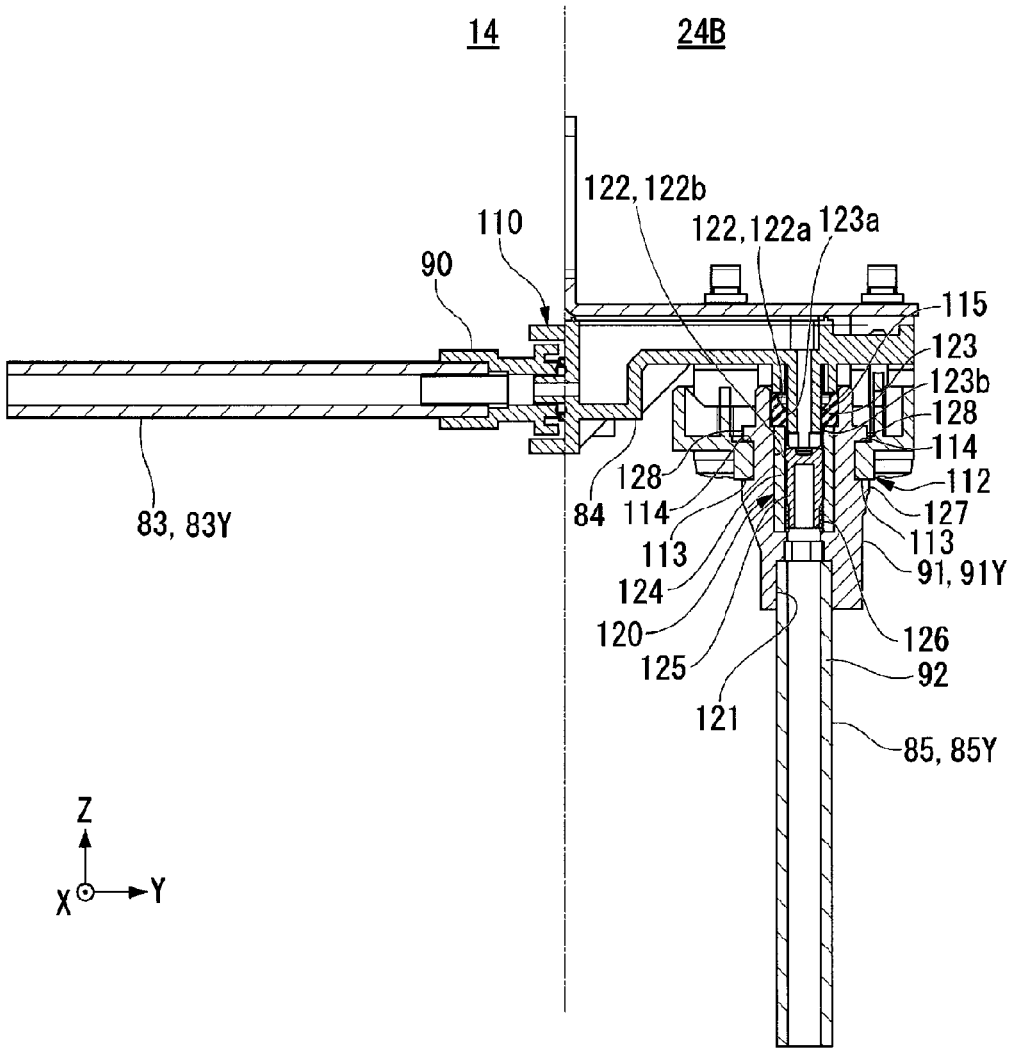
FIG. 4 is a cross-sectional view illustrating a state of connection of a coupling member to a second relay portion according to the first embodiment of the invention.
Figure 5:
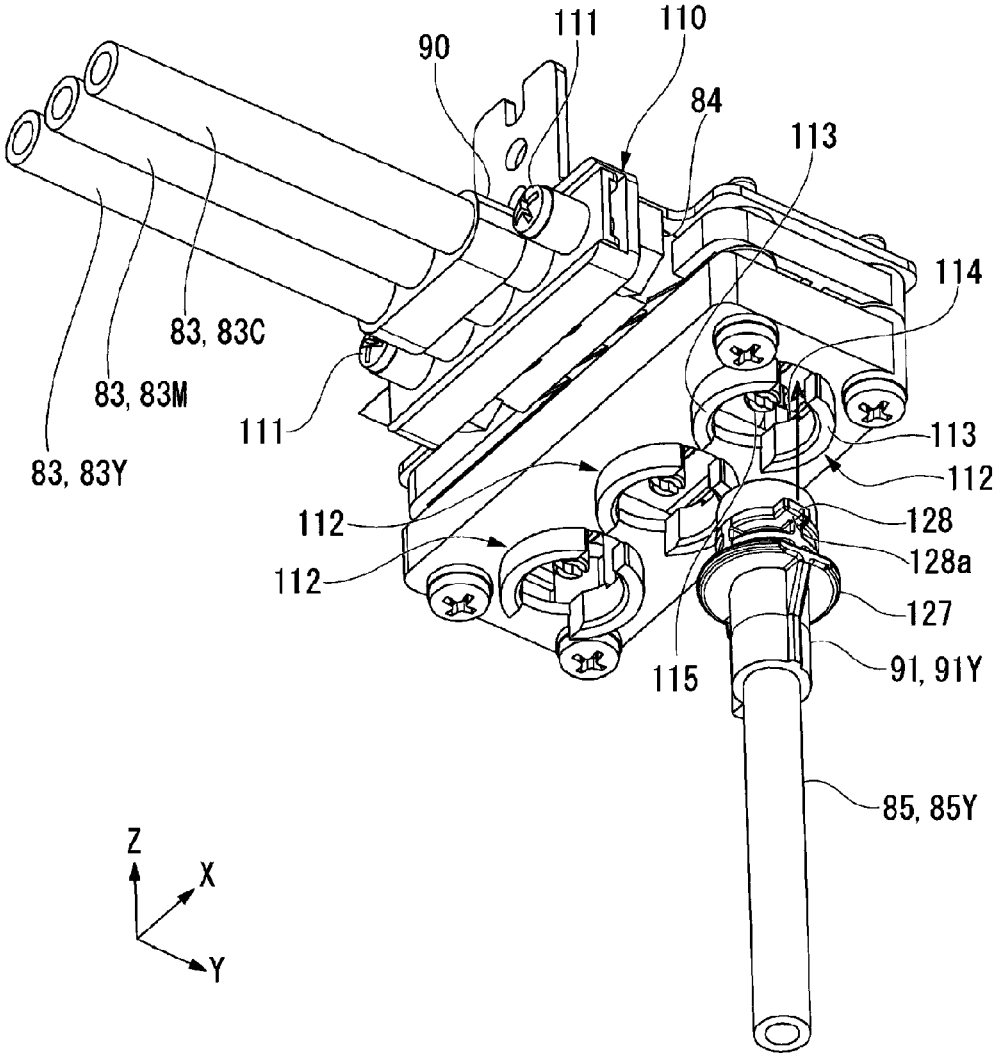
FIG. 5 is a perspective view illustrating an appearance of the coupling member being attached to the second relay portion according to the first embodiment of the invention.
Figure 6:
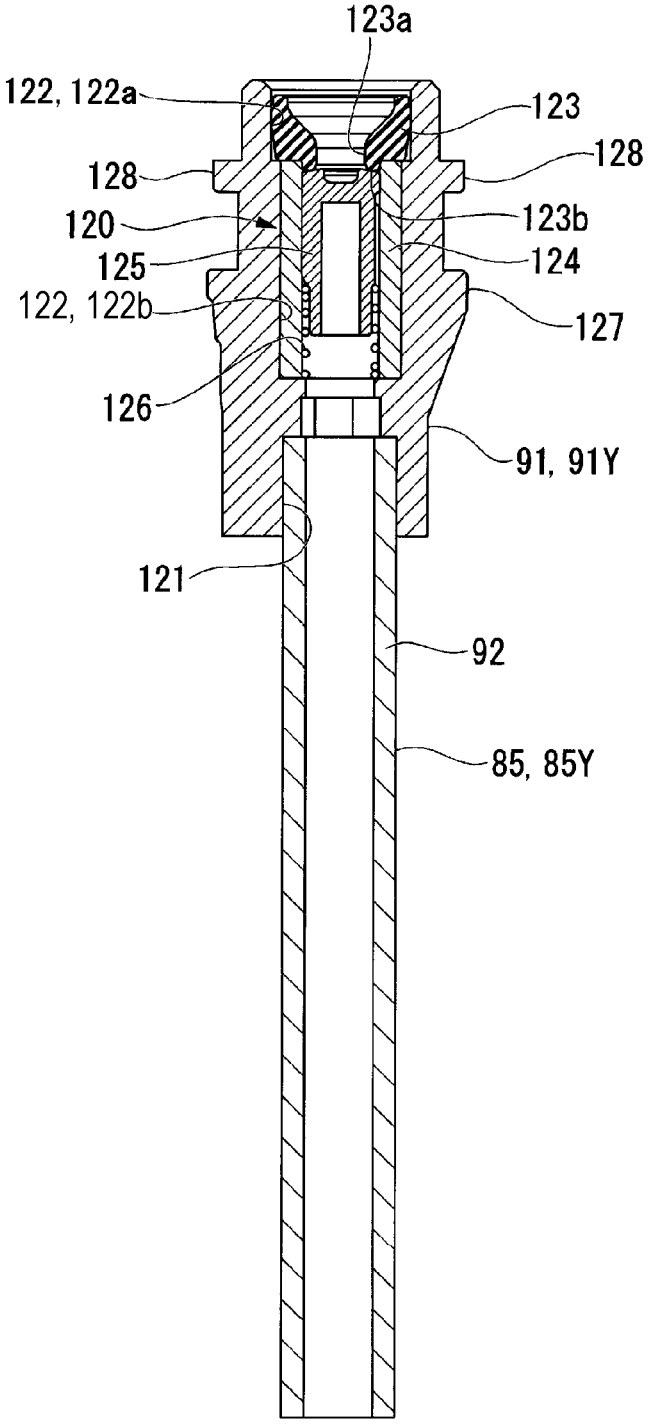
FIG. 6 is a cross-sectional view illustrating an unattached state of the coupling member according to the first embodiment of the invention.
Figure 7:
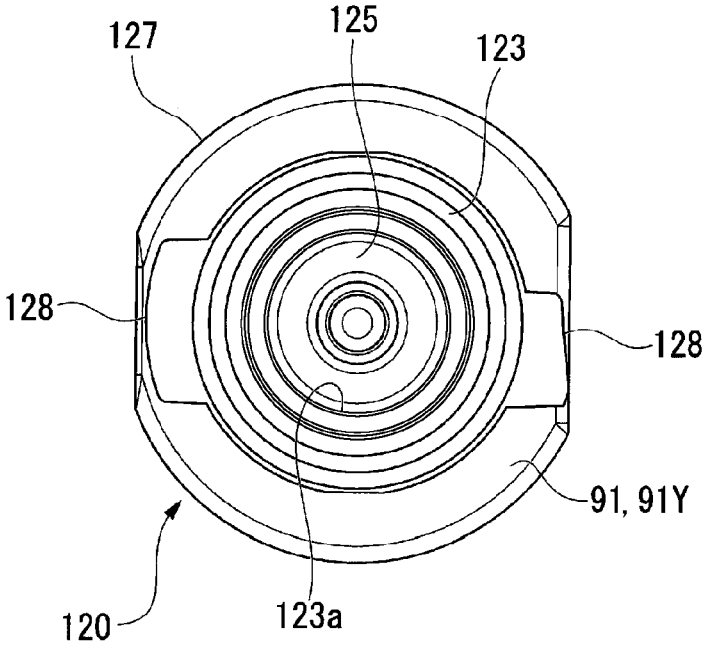
FIG. 7 is a drawing of the coupling member according to the first embodiment of the invention, viewed from a connecting direction.

FIG. 4 is a cross-sectional view illustrating a state of connection of coupling members 90 and 91 to the second relay portion 84 according to the first embodiment of the invention. FIG. 5 is a perspective view illustrating an appearance of the coupling member 91 being attached to the second relay portion 84 according to the first embodiment of the invention. FIG. 6 is a cross-sectional view illustrating an unattached state of the coupling member 91 according to the first embodiment of the invention. FIG. 7 is a drawing of the coupling member 91 according to the first embodiment of the invention, viewed from a connecting direction.

As illustrated in FIGS. 4 and 5, the second relay portion 84 includes a first connection portion 110 to which the coupling member 90 connects, and a second connection portion 112 to which the coupling member 91 connects. As illustrated in FIG. 5, the first connection portion 110 is connected via the fixing members 111 to the coupling member 90 common to the first flow paths 83C, 83M, and 83Y. The fixing members 111 are screw members and fix the first connection portion 110 and the coupling member 90 together. As illustrated in FIG. 4, the coupling member 90 is positioned in the housing space 14 inside the case member 11 and, as such, can be assembled completely within the case member 11. As illustrated in FIG. 3, the coupling members 86 and 87*a* housed in the housing space 14 inside the case member 11 are affected (subjected to vibration or the like) somewhat by the movement of the liquid ejecting head 60 and, as such, are preferably fixed with screws or the like in the same manner as the coupling member 90.

The second connection portion 112 is provided for each of the coupling members 91C, 91M, and 91Y. As illustrated in FIG. 6, the coupling members 91 have a sealing mechanism 120 that prevents the liquid from leaking when the second connection portion 112 is not connected to the coupling member 91. Note that the configuration of the sealing mechanisms 120 provided in the coupling members 91C, 91M, and 91Y is the same for each and, therefore, only the configuration of the sealing mechanism 120 provided in the coupling member 91Y is described below.

The coupling member 91 has a roughly cylindrical shape and includes a fitting groove 121 in which the tubing 92 that forms a portion of the second flow path 85 is fitted, and a receiving groove 122 that receives the sealing mechanism 120. The receiving groove 122 includes a large diameter portion 122*a* open toward a connecting face of the coupling member 91, and a small diameter portion 122*b* that is in communication with the large diameter portion 122*a*. A roughly cylindrical gasket 123 formed from an elastomer is housed in the large diameter portion 122*a*. An annular valve seat 123*b* is formed in the gasket 123 that protrudes toward the small diameter portion 122*b* and follows a periphery of an aperture 123*a* penetrating a center of the gasket 123.

A cylindrical valve guide 124 is housed in the small diameter portion 122*b*. An inner diameter of the valve guide 124 is larger than an inner diameter of the gasket 123 (the aperture 123*a*). A valve body 125 capable of contacting and separating from the valve seat 123*b* is provided inward of the valve guide 124. The valve body 125 has a bottomed cylindrical shape capable of closing the aperture 123*a*. A urging member 126 that biases the valve body 125 in a direction of close contact with the valve seat 123*b* is interposed between the valve body 125 and a bottom surface of the small diameter portion 122*b*. The urging member 126 is a compression coil spring and maintains a closed state by bringing the valve body 125 into close contact with the valve seat 123*b* of the gasket 123.

A flange 127 and a pair of engaging protrusions 128 are formed on an outer circumferential surface of the coupling member 91. On the other hand, as illustrated in FIGS. 4 and 5, the second connection portion 112 includes a pair of contacting portions 113 where the flange 127 contacts; engagement grooves 114 where the pair of engaging protrusions 128 engage; and an insertion portion 115 that causes the valve body 125 to resist the urging force of the urging member 126 and move, and set the sealing mechanism 120 to the open state. As illustrated in FIG. 5, the pair of contacting portions 113 are each formed in an arcuate shape, and both ends of the arcuate shapes face each other across a gap. The gaps between the pair of contacting portions 113 are of a size such that the pair of engaging protrusions 128 can be inserted.

As illustrated in FIG. 4, the engagement grooves 114 are formed on a back side of the pair of contacting portions 113. The pair of engaging protrusions 128 is passed through the gaps in the pair of contacting portions 113 and rotated about a central axis. Thus, the pair of engaging protrusions 128 is engaged with the engagement grooves 114. As illustrated in FIG. 7, the pair of engaging protrusions 128 have an asymmetrical shape. As illustrated in FIG. 5, a slanted surface 128*a* is provided on one of the pair of engaging protrusions 128 so as to facilitate ease of engagement with the engagement groove 114. As a result, it is possible to rotate the coupling member 91 about the central axis without completely inserting the second connection portion 112. Additionally, due to the action of the slanted surface 128*a*, when the coupling member 91 is rotated about the central axis, the coupling member 91 is plugged completely into the second connection portion 112.

As illustrated in FIG. 5, the insertion portion 115 is disposed in the center of the pair of contacting portions 113. The insertion portion 115 has a cylindrical shape of which a tip portion is bisected. When the coupling member 91 is plugged completely into the second connection portion 112, as illustrated in FIG. 4, the tip portion of the insertion portion 115 resists the urging force of the urging member 126 and presses the valve body 125 down. At this time, the gasket 123 is in close contact with the outer circumferential surface of the insertion portion 115 and a seal is maintained. When the valve body 125 separates from the valve seat 123*b* of the gasket 123 the open state will be assumed and liquid from the tubing 92 will pass through the gap between the valve body 125 and the valve guide 124 and flow into the gap formed by the bisected tip portion of the insertion portion 115.

On the other hand, the second flow paths 85 are removed from the second relay portion 84 in order to perform maintenance on the attachment unit 30. When removed, the tip portion of the insertion portion 115 of the second connection portion 112 separates from the valve body 125. As such, as illustrated in FIG. 6, in accordance with the urging force of the urging member 126, the valve body 125 closely contacts the valve seat 123*b* of the gasket 123 and assumes the closed state in which the aperture 123*a* of the gasket 123 is closed. As a result, the open end of the connecting surface of the coupling member 91 is sealed by the sealing mechanism 120. Accordingly, the liquid remaining in the tubing 92 is prevented from leaking out through the open end.

As described above, leaking of liquid when the second flow paths 85 are removed can easily be prevented by providing the sealing mechanism 120 in the coupling member 91. As illustrated in FIGS. 3 and 4, the coupling member 91 is housed in the housing space 26B inside the case member 22B. As such, when performing maintenance on the attachment unit 30C, 30M, or 30Y, the second flow paths 85 can easily by removed by opening the case member 22B and maintenance can be performed without opening the case member 11. Note that preferably, a detachable cover member covering the coupling member 91 is provided on the housing space 26B inside the case member 22B so as to prevent a user from unintentionally touching the coupling member 91.

Next, a configuration for preventing leaking of liquid in the head flow path 81 will be described while referencing FIGS. 8 to 10.

Figure 8:
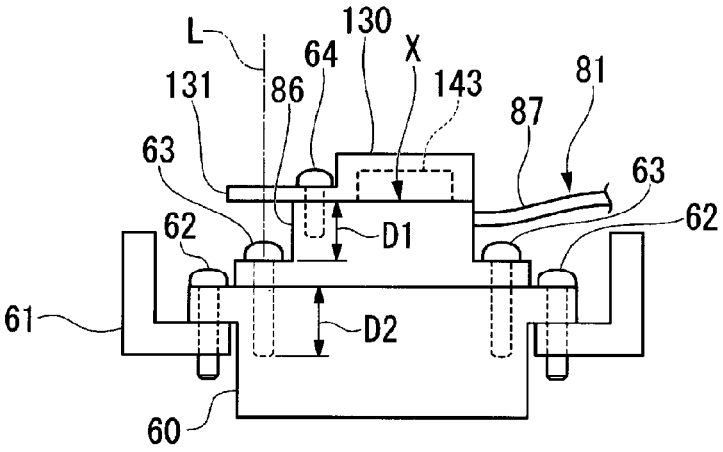
FIG. 8 is a side view illustrating a state of connection of a head flow path to a liquid ejecting head according to the first embodiment of the invention.

FIG. 8 is a side view illustrating a state of connection of a head flow path 81 to a liquid ejecting head 60 according to the first embodiment of the invention. FIG. 9 is a cross-sectional view illustrating an open state of the head flow path 81 according to the first embodiment of the invention. FIG. 10 is a cross-sectional view illustrating a closed state of the head flow path 81 according to the first embodiment of the invention.

As illustrated in FIG. 8, the liquid ejecting head 60 is supported on a supporting member 61. The supporting member 61 is a carriage that moves the liquid ejecting head 60 back and forth in the primary scanning direction. The liquid ejecting head 60 is fixed to the supporting member 61 via a fixing member 62 (second fixing member). The fixing member 62 is a screw member and fixes the liquid ejecting head 60 to the supporting member 61 at a plurality of locations.

The head flow path 81 is fixed to the liquid ejecting head 60 via a fixing member 63 (first fixing member). The fixing member 63 is a screw member and fixes the coupling member 86 of the head flow path 81 to the liquid ejecting head 60 at a plurality of locations.

The attaching member 130 is attached at a position X adjacent to the head flow path 81. The adjacent position X is set outside of the head flow path 81. As illustrated in FIG. 9, the adjacent position X of the present embodiment is set at a position adjacent to an inner flow path 86*a* of the coupling member 86 via a dividing wall 86*b*. As illustrated in FIG. 8, the attaching member 130 is fixed to the coupling member 86 via a fixing member 64. The fixing member 64 is a screw member.

As illustrated in FIG. 8, when the attaching member 130 is attached at the adjacent position X, the attaching member 130 includes an interfering portion 131 positioned on at least one operation path L of the plurality of fixing members 63. The operation path L of the fixing member 63 is a path to access the fixing member 63 using a tool (in the present embodiment, a screwdriver for rotating the screw member). The interfering portion 131 has a plate shape that crosses the operation path L, and prevents a tool from accessing the fixing member 63.

A distance D1 from a fixing surface (seat) of the fixing member 63 to the in 131 is shorter than a distance D2 that the fixing member 63 is inserted (screwed) into the liquid ejecting head 60. As such, the fixing member 63 cannot be removed without removing the attaching member 130. The material and shape of the attaching member 130 are not particularly limited, but the attaching member 130 is preferably formed from, for example, a light-weight resin material or the like because the attaching member 130 moves together with the liquid ejecting head 60.

Figure 9:
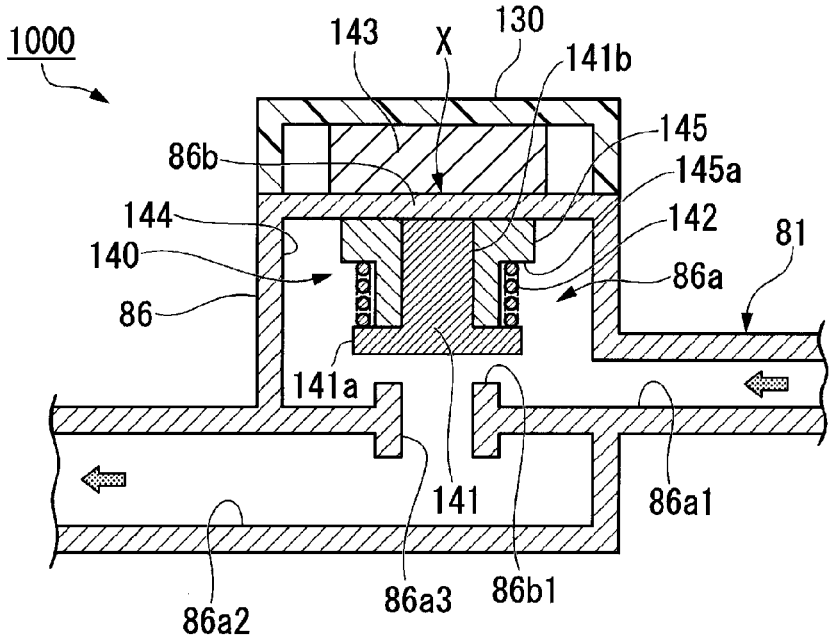
FIG. 9 is a cross-sectional view illustrating an open state of the head flow path according to the first embodiment of the invention.
Figure 10:
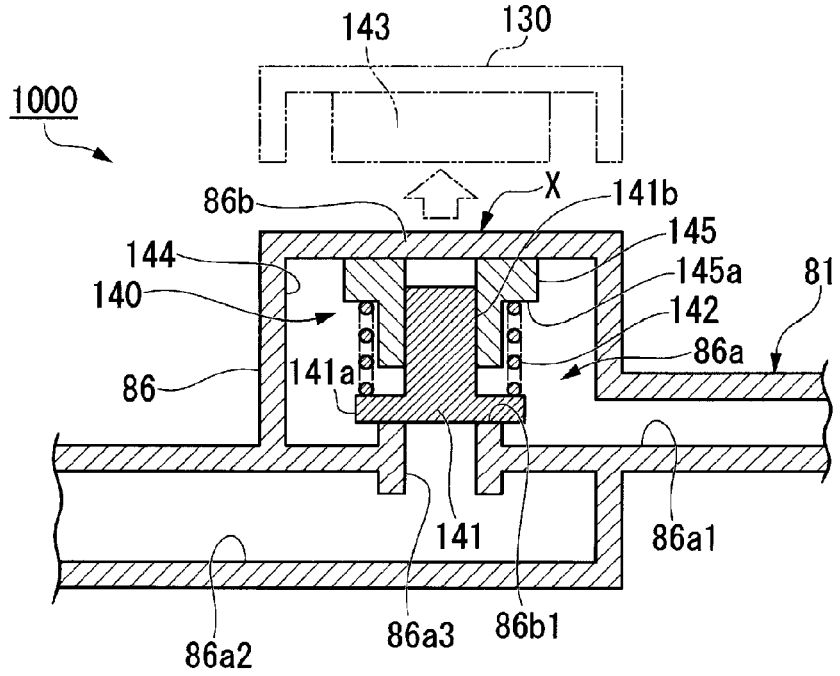
FIG. 10 is a cross-sectional view illustrating a closed state of the head flow path according to the first embodiment of the invention.

As illustrated in FIGS. 9 and 10, the liquid ejecting apparatus 1000 includes an opening/closing mechanism 140 that opens the head flow path 81 when the attaching member 130 is attached at the adjacent position X and closes the head flow path 81 when the attaching member 130 is removed from the adjacent position X. The opening/closing mechanism 140 includes a valve body 141 and a urging member 142 provided within the inner flow path 86*a* of the coupling member 86, and a magnet 143 provided on the attaching member 130.

An upstream flow path 86*a*1 in communication with a tubing 87, a downstream flow path 86*a*2 in communication with the liquid ejecting head 60, and an aperture 86*a*3 constituting a connection between the upstream flow path 86*a*1 and the downstream flow path 86*a*2 are provided in the inner flow path 86*a*. The coupling member 86 includes an annular valve seat 86*b*1 that follows the periphery of the aperture 86*a*3. A valve chamber 144 is provided in the upstream flow path 86*a*1 A cylindrical valve guide 145 is housed in the valve chamber 144. A valve body 141 capable of contacting and separating from the valve seat 86*b*1 is provided inward of the valve guide 145.

The valve body 141 includes a head portion 141*a* capable of closing the aperture 86*a*3, and a shaft portion 141*b* guided by the valve guide 145. At least a portion of the valve body 141 is formed from a magnetic material such as iron or the like. For example, in a case where the valve seat 86*b*1 is formed from a resin member such as packing material or the like, an entirety of the valve body 141 may be formed from the magnetic material. For example, in a case where the valve seat 86*b*1 is a portion of the dividing wall 86*b* and the head portion 141*a* is formed from a resin member such as packing material or the like, it is preferable that at least an end portion of the shaft portion 141*b* facing the dividing wall 86*b* be the magnetic material.

The valve body 141 is movable between an open position (FIG. 9) where the head flow path 81 (the aperture 86*a*3) is open and a closed position (FIG. 10) where the head flow path 81 (the aperture 86*a*3) is closed. The valve guide 145 includes a step portion 145*a* on an outer circumferential surface thereof. A urging member 142 is interposed between the step portion 145*a* of the valve guide 145 and the head portion 141*a* of the valve body 141. The urging member 142 is a compression coil spring and biases the valve body 141 from the open position (FIG. 9) toward the closed position (FIG. 10).

As illustrated in FIG. 9, the magnet 143 resists the urging force of the urging member 142 and positions the valve body 141 in the open position while the attaching member 130 is attached at the adjacent position X. The magnet 143 is fixed to the attaching member 130 by, for example, an adhesive or the like. Note that a configuration is possible in which a fitting groove is formed in the attaching member 130, and the magnet 143 is fitted into the attaching member 130. The magnet 143 faces the end portion of the shaft portion 141*b* of the valve body 141 via the dividing wall 86*b* while the attaching member 130 is attached at the adjacent position X.

The dividing wall 86*b* may be any substance provided that the magnetic force of the magnet 143 is allowed to act on the valve body 141 and, for example, may be formed from a non-magnetic material such as a resin material or the like. The magnet 143 causes a magnetic force larger than the urging force of the urging member 142 to act on the valve body 141, and preferably a suitable material is selected depending on the material (spring constant) of the urging member 142.

According to opening/closing mechanism 140 configured as described above, as illustrated in FIG. 9, while the attaching member 130 is attached at the position X adjacent to the head flow path 81, the magnet 143 provided on the attaching member 130 is magnetically attracted to the valve body 141 that includes the magnetic material and, thereby, the head flow path 81 can be opened. As illustrated in FIG. 10, when the attaching member 130 is removed from the position X adjacent to the head flow path 81, the magnetic force of the magnet 143 ceases to act, the urging member 142 causes the valve body 141 to move to the closed position and, thereby, the head flow path 81 can be closed.

As such, according to the opening/closing mechanism 140, the attaching and removing of the attaching member 130 that is attachable at the position X adjacent to the head flow path 81 can be associated with the opening and the closing of the head flow path 81. That is, the attaching member 130 is removed from the position X adjacent to the head flow path 81 before the head flow path 81 is removed from the liquid ejecting head 60 and, therefore, the head flow path 81 can be closed in advance by the opening/closing mechanism 140. Accordingly, when removing the head flow path 81 in order to replace the liquid ejecting head 60 or the like, leaking of the liquid can be prevented, maintenance can be performed in a short period of time, and serviceability can be improved.

The position X adjacent to the attaching member 130 is set outside of the head flow path 81 (the dividing wall 86*b*).

According to this configuration, the head flow path 81 can be closed from the outside by removing the attaching member 130 that is attached outside the head flow path 81 and, therefore, leaking of the liquid can be reliably prevented.

As illustrated in FIG. 8, in the present embodiment, the fixing member 63 for fixing the head flow path 81 to the liquid ejecting head 60 is provided and, when the attaching member 130 is attached at the adjacent position X, the attaching member 130 includes the interfering portion 131 positioned on the operation path L of the fixing member 63. According to this configuration, the interfering portion 131 disables the operation (access of a tool to the fixing member 63) of the fixing member 63 and, therefore, unless the attaching member 130 is removed in advance, the head flow path 81 cannot be removed from the liquid ejecting head 60. As a result, situations can be avoided where the head flow path 81 is removed from the liquid ejecting head 60 while the head flow path 81 is not closed, which would lead to leaking of the liquid.

As described above, according to the present embodiment, the liquid ejecting apparatus 1000 includes the liquid ejecting head 60 that ejects the liquid; the head flow path 81 that is connected to the liquid ejecting head 60 and that supplies the liquid; the attaching member 130 that is attachable at the position X adjacent to the head flow path 81; and the opening/closing mechanism 140 that opens the head flow path 81 when the attaching member 130 is attached at the adjacent position X, and closes the head flow path 81 when the attaching member 130 is removed from the adjacent position X. As such, leaking of the liquid can be prevented when removing the head flow path 81 to replace the liquid ejecting head 60 or the like, maintenance can be performed in a short period of time, and serviceability can be improved.

Second Embodiment

Next, a second embodiment of the invention will be described. In the following description, constituents that are identical or equivalent to those recited in the first embodiment are assigned the same reference signs and description thereof if simplified or omitted.

Figure 11:
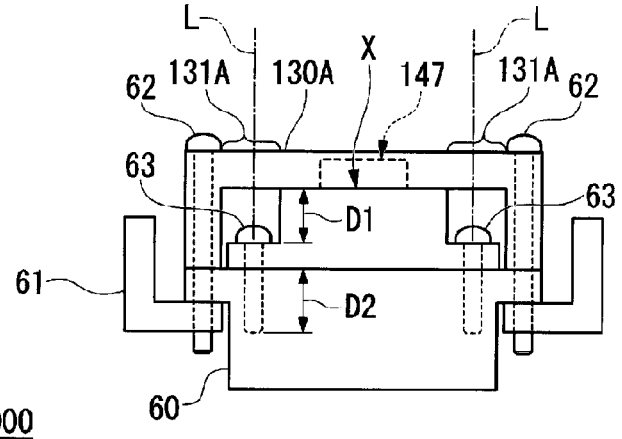
FIG. 11 is a side view illustrating an attached state of an attaching member according to a second embodiment of the invention.
Figure 12:
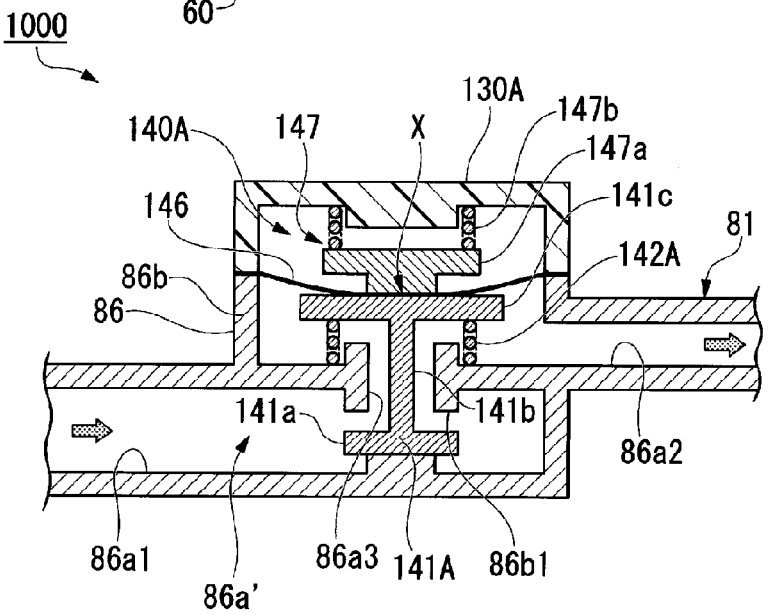
FIG. 12 is a cross-sectional view illustrating an open state of the head flow path according to the second embodiment of the invention.
Figure 13:
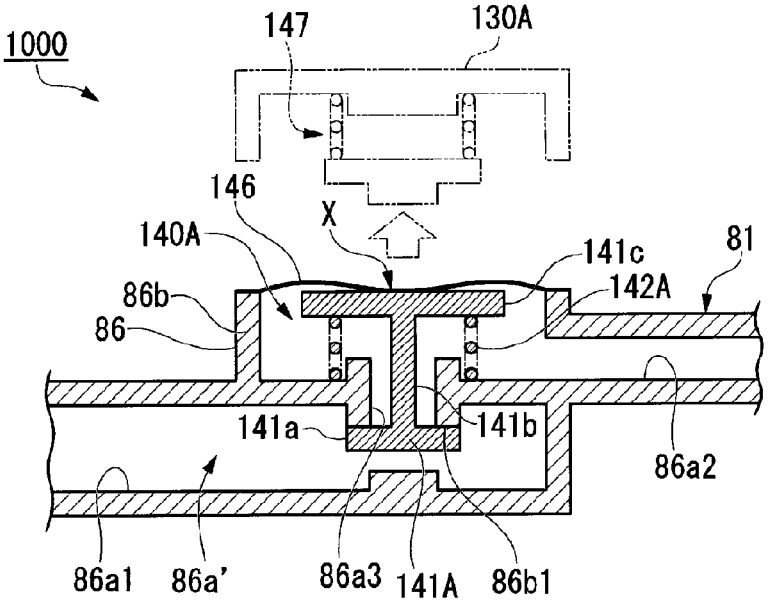
FIG. 13 is a cross-sectional view illustrating a closed state of the head flow path according to the second embodiment of the invention.

FIG. 11 is a side view illustrating an attached state of an attaching member 130A according to a second embodiment of the invention. FIG. 12 is a cross-sectional view illustrating an open state of the head flow path 81 according to the second embodiment of the invention. FIG. 13 is a cross-sectional view illustrating a closed state of the head flow path 81 according to the second embodiment of the invention.

As illustrated in FIG. 11, an attaching member 130A of the second embodiment is fixed together with the liquid ejecting head 60 to the supporting member 61 via the fixing member 62 (second fixing member). The attaching member 130A has a rough gate-like shape and, as illustrated in FIG. 11, when the attaching member 130A is attached at the adjacent position X, the attaching member 130A includes a plurality of interfering portions 131A positioned on the operation paths L of the plurality of fixing members 63.

As illustrated in FIGS. 12 and 13, an opening/closing mechanism 140A of the second embodiment includes a flexible film 146 that forms a portion of the head flow path 81, a valve body 141A and a urging member 142A provided within the inner flow path 86*a*', and a pressing member 147 provided on the attaching member 130A. In the second embodiment, a portion of the dividing wall 86*b* of the downstream flow path 86*a*2 of the inner flow path 86*a*' is formed from the flexible film 146. Additionally, the position X adjacent to the attaching member 130A is set at a position adjacent to the inner flow path 86*a*' of the coupling member 86 via the flexible film 146.

A valve body 141A includes the head portion 141*a* that is capable of closing the aperture 86*a*3 at the upstream flow path 86*a*1, the shaft portion 141*b* that passes through the aperture 86*a*3, and a flange portion 141*c* that is pressed on by the pressing member 147 at the downstream flow path 86*a*2. The urging member 142A is interposed between the flange portion 141*c* and the bottom surface of the downstream flow path 86*a*2. The urging member 142 is a compression coil spring and biases the valve body 141A from the open position (FIG. 12) toward the closed position (FIG. 13).

As illustrated in FIG. 12, the pressing member 147 presses the valve body 141A via the flexible film 146 and resists the urging force to position the valve body 141A in the open position while the attaching member 130A is attached at the adjacent position X. The pressing member 147 includes a pressing part 147*a* and a urging member 147*b*. The pressing part 147*a* faces the flange portion 141*c* of the valve body 141A via the flexible film 146 while the attaching member 130A is attached at the adjacent position X. The urging member 147*b* is a compression coil spring, has a spring constant that is greater than a spring constant of the urging member 142A, and causes urging force greater than that of the urging member 142A to act on the valve body 141A.

According to the opening/closing mechanism 140A thusly configured, as illustrated in FIG. 12, while the attaching member 130A is attached at the position X adjacent to the head flow path 81, the pressing member 147 provided on the attaching member 130A will press on the valve body 141A via the flexible film 146 and, thereby, the head flow path 81 can be opened. As illustrated in FIG. 13, when the attaching member 130A is removed from the position X adjacent to the head flow path 81, the pressing of the pressing member 147 ceases to be applied, the urging member 142A causes the valve body 141A to move to the closed position and, thereby, the head flow path 81 can be closed.

As such, according to the opening/closing mechanism 140A, the attaching and removing of the attaching member 130A that is attachable at the position X adjacent to the head flow path 81 can be associated with the opening and the closing of the head flow path 81. That is, the attaching member 130A is removed from the position X adjacent to the head flow path 81 before the head flow path 81 is removed from the liquid ejecting head 60 and, therefore, the head flow path 81 can be closed in advance by the opening/closing mechanism 140A. Accordingly, when removing the head flow path 81 in order to replace the liquid ejecting head 60 or the like, leaking of the liquid can be prevented, maintenance can be performed in a short period of time, and serviceability can be improved.

In the present embodiment, as illustrated in FIG. 11, the supporting member 61 that supports the liquid ejecting head 60, and the fixing member 62 that fixes the attaching member 130A together with the liquid ejecting head 60 to the supporting member 61 are provided. According to this configuration, the attaching member 130A is removed when the fixing member 62 operates and releases the fixing between the liquid ejecting head 60 and the supporting member 61. As a result, the head flow path 81 can be closed simultaneously with the releasing of the fixing between the liquid ejecting head 60 and the supporting member 61.

Preferred embodiments of the invention have been described while referencing to drawings, but the invention is not limited to these embodiments. The shapes and combinations of the constituents described in the embodiments should not be construed to be more than examples, and various modifications based on design requirements and the like are possible without departing from the scope of the invention.

For example, a configuration is possible in which a pressure-regulating valve is integrally mounted on the liquid ejecting head. According to such a configuration, leaking of the liquid from the liquid ejecting head can be reliably prevented, even in cases where the head flow path is removed from the liquid ejecting head.

For example, a configuration is possible in which, the liquid stored in the liquid container is not supplied to the liquid ejecting head by a supplying mechanism having a pump function, rather the liquid stored in the liquid container is supplied to the liquid ejecting head by a water head difference introduced by providing the liquid container above the liquid ejecting head.

For example, a configuration is possible in which the liquid container is not a pack type in which a liquid is stored, but rather is a cartridge type, a bottle type, or a refillable tank.

For example, a configuration is possible in which, in the first embodiment and the second embodiment, the head flow path is open when the attaching member is removed and the head flow path is closed by attaching the attaching member. In this case, the urging member within the inner flow path is preferably configured to bias the valve body in the opening direction.

Configurations are possible in which the liquid ejecting apparatus in the embodiment described above is a thermal jet printer or a line ink jet printer. Moreover, the liquid ejecting apparatus is not limited to a printer and may be a copier, a facsimile, or similar device.

A configuration is possible in which the liquid ejecting apparatus ejects or discharges a liquid other than ink. The invention is usable in any type of liquid ejecting apparatus that includes a liquid ejecting head or the like for discharging minute amounts of liquid droplets. Note that granular shaped liquid droplets, tear shaped liquid droplets, and thread shaped liquid droplets leaving a trail are included in the definition of "droplets" ejected from the liquid ejecting apparatus. Additionally, "liquid" as used herein, may be any material, provided that it can be ejected from the liquid ejecting apparatus. For example, the material may be any material in a state of liquid phase, and examples thereof include materials which flow such as liquids of high or low viscosity, sols, gel water, inorganic solvents, organic solvents, solutions, liquid resins, liquid metals (metallic melts), and the like. In addition, the term "liquid" includes not only the liquid state of a material, but also materials in which particles of a functional material which is formed of a solid body such as a pigment or metal particles are melted, or diffused, or mixed into a solvent. Representative examples of the liquid include the ink described in the embodiment described above. Herein, the term "ink" includes general water-based inks and oil-based inks, and also a variety of liquid compositions such as gel inks, hot-melt inks, and the like.

The entire disclosure of Japanese Patent Application No. 2015-215006, filed Oct. 30, 2015 is expressly incorporated by reference herein.

What is claimed is:

1. A liquid ejecting apparatus, comprising:

a liquid ejecting head that ejects liquid;

a head flow path connected to the liquid ejecting head, that supplies the liquid;

an attaching member that is attachable at a position adjacent to the head flow path;

an opening/closing mechanism that opens the head flow path when the attaching member is attached at the adjacent position and closes the head flow path when the attaching member is removed from the adjacent position;

within the head flow path, a valve body that is movable between an open position where the head flow path is open and a closed position where the head flow path is closed, and of which at least one portion is formed from a magnetic material;

within the head flow path, an urging member that biases the valve body from the open position toward the closed position while the attaching member is not attached at the adjacent position; and a magnet that is provided on the attaching member and that resists the urging and positions the valve body at the open position while the attaching member is attached at the adjacent position.

2. The liquid ejecting apparatus according to claim 1, further comprising:

a first fixing member that fixes the head flow path to the liquid ejecting head; and an interfering portion positioned on an operation path of the first fixing member when the attaching member is attached at the adjacent position.

3. The liquid ejecting apparatus according to claim 2, wherein the interfering portion is configured to prevent removal of the first fixing member by prevent tool access to the first fixing member.

4. The liquid ejecting apparatus according to claim 1, further comprising:

a supporting member that supports the liquid ejecting head; and a second fixing member that fixes the liquid ejecting head together with the attaching member to the supporting member.

5. A liquid ejecting apparatus, comprising:

a liquid ejecting head that ejects liquid;

a head flow path connected to the liquid ejecting head, that supplies the liquid;

an attaching member that is attachable at a position adjacent to the head flow path;

an opening/closing mechanism that opens the head flow path when the attaching member is attached at the adjacent position and closes the head flow path when the attaching member is removed from the adjacent position;

a flexible film that forms a portion of the head flow path;

within the head flow path, a valve body that is movable between an open position where the head flow path is open and a closed position where the head flow path is closed;

within the head flow path, a urging member that biases the valve body from the open position toward the closed position; and a pressing member that is provided on the attaching member and that resists the urging and positions the valve body at the open position by pressing the valve body via the flexible film while the attaching member is attached at the adjacent position, wherein the flexible film is configured to separate the pressing member and the valve body such that the pressing member and the valve body do not directly contact one another.

6. The liquid ejecting apparatus according to claim 5, further comprising:

a first fixing member that fixes the head flow path to the liquid ejecting head; and an interfering portion positioned on an operation path of the first fixing member when the attaching member is attached at the adjacent position.

7. The liquid ejecting apparatus according to claim 6, wherein the interfering portion is configured to prevent removal of the first fixing member by prevent tool access to the first fixing member.

8. The liquid ejecting apparatus according to claim 5, further comprising:

a supporting member that supports the liquid ejecting head; and a second fixing member that fixes the liquid ejecting head together with the attaching member to the supporting member.

* * * * *